United States Patent [19]

Reimar

[11] 4,403,823

[45] Sep. 13, 1983

[54] ELECTRICAL CONTACT FOR POSITION MEASURING INSTRUMENT

[75] Inventor: Wolfgang Reimar, Traunreut, Fed. Rep. of Germany

[73] Assignee: Dr. Johannes Heidenhain GmbH, Traunreut, Fed. Rep. of Germany

[21] Appl. No.: 240,901

[22] Filed: Mar. 5, 1981

[30] Foreign Application Priority Data

Mar. 11, 1980 [DE] Fed. Rep. of Germany ..... 3009236

[51] Int. Cl.[3] ..... H01R 13/415

[52] U.S. Cl. ..... 339/126 R; 339/132 R; 339/220 R

[58] Field of Search ..... 339/126, 130, 131, 132, 339/206, 207, 213, 214, 215, 217, 220, 221, 17 R, 17 C, 17 E, 17 D

[56] References Cited

U.S. PATENT DOCUMENTS

| | | | |
|---|---|---|---|
| 11,968 | 2/1902 | Greil et al. | 339/126 R |
| 1,100,178 | 6/1914 | Forsberg | 339/220 R |
| 1,203,582 | 11/1916 | Chase | 339/132 B |
| 2,148,201 | 2/1939 | Houwink | 339/17 R |
| 2,603,681 | 7/1952 | Salisbury | 339/17 D |
| 2,713,670 | 7/1955 | Koch | 339/207 R |
| 2,931,007 | 3/1960 | Abrams | 339/220 R |
| 2,991,440 | 7/1961 | Kulka | 339/220 R |
| 3,064,218 | 11/1962 | Farrand | 336/129 |
| 3,372,319 | 3/1968 | Rhodes | 339/17 R |
| 3,384,862 | 5/1968 | Shroyer | 339/126 RS |
| 3,725,849 | 4/1973 | Becke | 339/126 J |

FOREIGN PATENT DOCUMENTS

| | | | |
|---|---|---|---|
| 1985138 | 7/1957 | Fed. Rep. of Germany . | |
| 1263327 | 3/1968 | Fed. Rep. of Germany . | |
| 1298299 | 6/1969 | Fed. Rep. of Germany . | |
| 52-73392 | 6/1977 | Japan | 339/17 C |
| 1402280 | 8/1975 | United Kingdom | 339/95 A |

OTHER PUBLICATIONS

IBM Bulletin, Schwartz, vol. 5, No. 6, pp. 15–16, 11–1962.

*Primary Examiner*—Neil Abrams
*Attorney, Agent, or Firm*—Hume, Clement, Brinks, Willian & Olds, Ltd.

[57] ABSTRACT

A position measuring instrument, of the type including a first component which includes a first electrically conductive sensor conductor and a second component, which includes a second electrically sensor conductor, wherein one of the two components is mounted to move relative to the other component, is provided with an improved connector which comprises at least one insulating member secured to the first component such that the insulating member is substantially prevented from rotating with respect to the first component, at least one electrically conducting contact member, which is secured to the insulating member such that the contact member is substantially prevented from rotating with respect to the first component, is substantially prevented from pulling out of the insulating member, and does not extend substantially beyond the first component, wherein the contact member is electrically connected to the first sensor conductor.

3 Claims, 2 Drawing Figures

FIG. 1
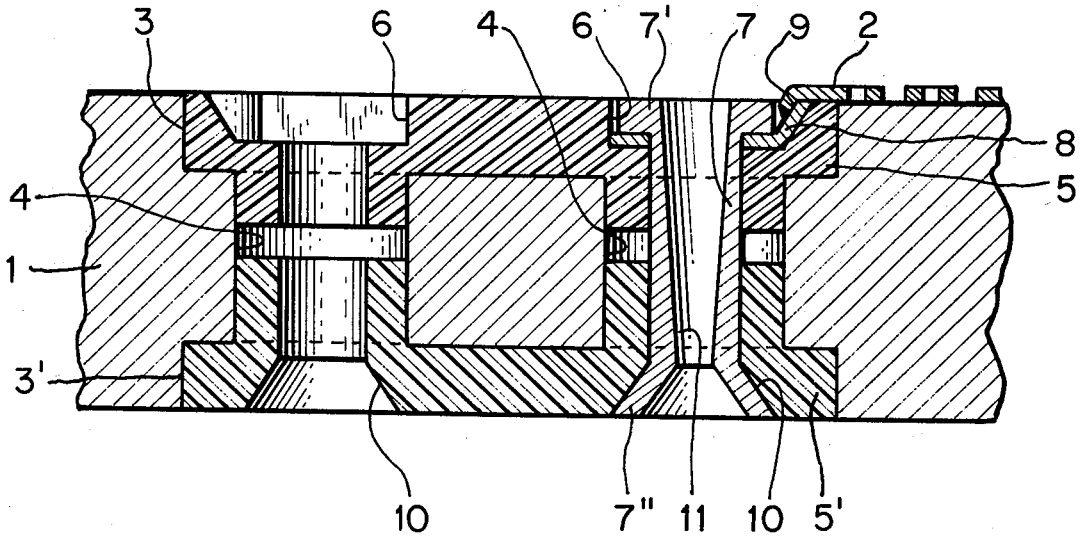
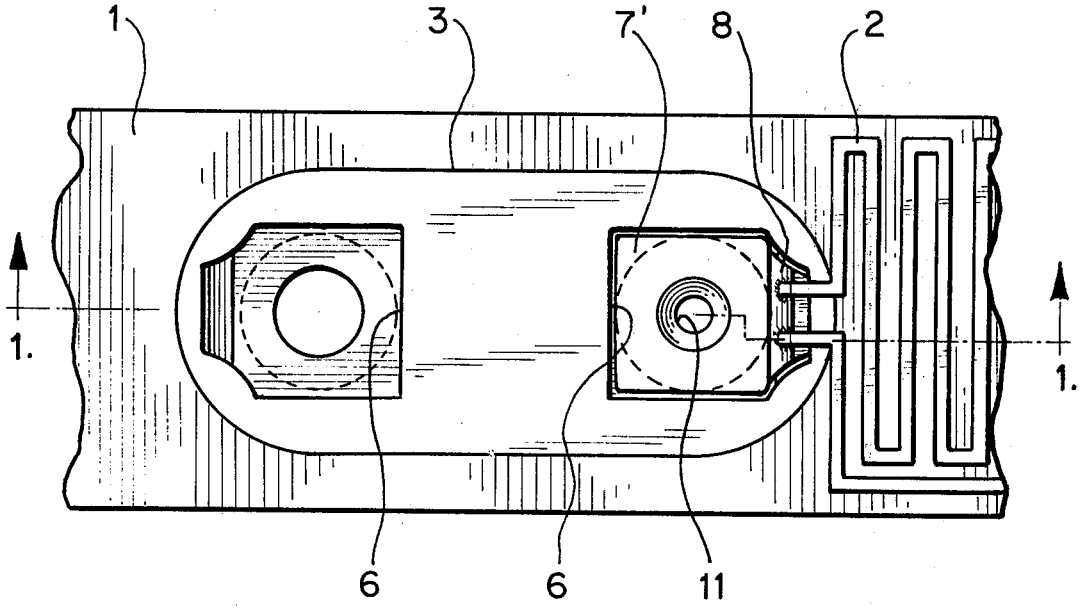
FIG. 2

ELECTRICAL CONTACT FOR POSITION MEASURING INSTRUMENT

BACKGROUND OF THE INVENTION

This invention relates to an improved electrical contact for a position measuring instrument of the type which includes a first component which is mounted to more relative to a second component, wherein both the first and second components comprise respective electrically conductive sensor conductors.

Measuring devices of the general type described above are known to the prior art. For example, German DE-AS 12 63 327, German DE-AS 12 98 299, and German DE-GM 19 85 138 all disclose connecting techniques for such measuring devices. Both DE-AS 12 63 327 and DE-GM 19 85 138 disclose electrically conducting sensor conductors embodied in conductor path form. In each case cables are soldered to the sensor conductors, and the cables are then led out of the instrument either by means of bores formed in the sensor conductor substrate or by passing the cables around the sensor conductor substrate.

In German DE-AS 12 98 299 a portion of the connections with the sensor conductors are formed by means of the conductor path technique on the back of the sensor conductor substrate as contact terminals. A portion of these terminals is located in recesses that are offset with respect to the plane of the sensor conductors.

Connections or terminals of the type discussed above exhibit certain disadvantages, since cable connections with the sensor conductor are mechanically sensitive. In particular, it is possible for the connections or terminals to be damaged or even torn away from the sensor conductors in the change of contact pins. Furthermore, connections or terminals of the type described above are not well suited for use with screw connections, since no provision is provided for preventing the terminal or connection from twisting under the torque of a screw.

SUMMARY OF THE INVENTION

The present invention is directed to an improved connection or terminal for use with electrically conducting sensor conductors of measuring instruments, which avoids the above-mentioned disadvantages of the prior art. This invention provides a measuring instrument with contact members which are securely connectable, which simplify the manufacture of the measuring instrument, and which can readily be connected with and disconnected from mating contact members without damaging the sensor conductors of the measuring instrument.

According to this invention a position measuring instrument of the type described above is provided with at least one insulating member secured to the first component of the measuring instrument such that the insulating member is substantially prevented from rotating with respect to the first component. At least one electrically conducting contact member is secured to the insulating member such that the contact member is substantially prevented from rotating with respect to the first component, the contact is substantially prevented from pulling out of the insulating member, and the contact member does not extend substantially beyond the first component. In addition, means are provided for electrically connecting the contact member with the sensor conductor of the first component. Further features of this invention are defined by the dependent claims.

The present invention provides a number of important advantages. First, because the contact member is securely mounted to the first component, electrical connections can be made with the contact member without damaging or jeopardizing the integrity of the sensor conductor. Second, the contact member is secured to the first component against rotation, and it is therefore possible to use screw connections if desired to make firm electrical contact with the contact member. Third, some embodiments of this invention provide a bore or passageway extending through the contact member, and it is therefore possible to coat or plate the bore with low resistance conductors, such as gold. Fourth, since the contact members do not extend beyond the surfaces of the first component, there is little likelihood that the contact member will be damaged in the assembly or in the operation of the measuring device. Fifth, certain embodiments of this invention allow electrical connections to be made either from the front or the back of the component on which the contact member is mounted.

The invention itself, together with further objects and attendant advantages, will best be understood by reference to the following detailed description taken in connection with the accompanying drawings.

BRIEF DESCRIPTION OF THE DRAWINGS

FIG. 1 is a cross-sectional view of a preferred embodiment of the present invention, taken along line 1—1 of FIG. 2. FIG. 2 is a top view of the embodiment of FIG. 1.

DETAILED DESCRIPTION OF THE PREFERRED EMBODIMENTS

Turning now to the drawings, FIG. 1 shows a cross-sectional view of a component of a measuring instrument into which is mounted the improved connection or terminal of this invention. The reference numeral 1 is used to indicate a metal component which serves as a substrate for a sensor conductor 2 which is formed on an outer surface of the component 1 by means of the conductor path etch technique. The sensor conductor 2 of this embodiment takes the form of an electrically conducting array. The functioning and operation of measuring instruments having such sensor conductors is adequately described in the above-mentioned patents, and no detailed description of the operation of this measuring device will be made here. In this embodiment the sensor conductor 2 is insulated with respect to the component 1.

The component 1 defines two opposed oblong recesses 3,3' which are situated on opposed surfaces of the component 1. These two recesses 3,3' are interconnected by means of two passages or holes 4 in such a way that shoulders are formed by the recesses 3,3'. Into each of these recesses 3,3' there is installed an element 5,5', respectively, of a two part insulating member. The insulating member element 5 should be formed of an insulating material such as a suitable plastic, for example, and can be produced by plastic injection molding techniques. This element 5 defines two spaced prismatic recesses 6, each of which is centered with respect to one of the holes 4. A contact member 7 is provided which defines an enlarged prismatic head 7'. This enlarged head 7' is shaped to fit within the prismatic recess 6 such that the contact member 7 is substantially prevented from rotating in the element 5. In addition, the recess 6 is sized to receive a soldering lug 8 between the insulating body 5 and the head 7' of the connecting member 7. This soldering lug 8 is formed of an electrically conductive material and is electrically connected to the sensor conductor 2 by means of a soldered junction 9. The insulating member element 5', which is preferably also formed of an injection molded plastic, defines on its outer surface conical recesses 10, each of which is centered with respect to a respective one of the holes 4. The contact member 7 can be conically widened at its end lying opposite the prismatic enlarged head 7', such that the spread open conical shell 7'' draws the two insulating member elements 5,5' together after assembly such that the elements 5,5' are firmly seated in the recesses 3,3', respectively, and it is substantially impossible either to rotate the contact element 7 or to draw the contact element 7 perpendicularly out of the component 1 unless the contact member 7 is deformed or destroyed.

The contact member 7 defines a passageway or bore 11 which passes through the length of the contact member 7. This bore 11 serves to receive a contact pin (not shown) which mates with the contact member 7 in order to establish electrical connection between the sensor conductor 2 and an electrical evaluating system (not shown) or with a supply voltage source for the sensor conductor 2.

In alternate embodiments of this invention, the bore 11 can be threaded to receive a correspondingly threaded contact pin (not shown). Also, the contact member 7 can be coated or electro-plated with a suitable conductor, such as gold, in the interior of the bore 11 in order to provide a more secure, low resistance electrical contact. Preferably, the sensor conductor 2 is coated with a protective lacquer layer in order to protect the sensor conductor 2 from damage.

Of course, it should be understood that various changes and modifications to the preferred embodiments described above will be apparent to those skilled in the art. The foregoing description of the preferred embodiment shown in the drawings is intended merely to describe in detail the presently preferred embodiment of the invention, and not to limit the scope of this invention. Rather, it is the following claims, including all equivalents, which are intended to define the present invention.

I claim:

1. In a position measuring instrument comprising a first component which includes a first electrically conducting sensor conductor and a second component which includes a second electrically conducting sensor conductor, wherein one of the two components is mounted to move relative to the other component, the improvement comprising:

means for defining first and second opposed oblong recesses in opposed surfaces of the first component;

means for defining at least one opening extending through the first component between the first and second oblong recesses;

first and second oblong insulating members shaped to fit within the first and second recesses, respectively, such that each insulating member is substantially prevented from rotating in the first component, each insulating member defining a hole passing therethrough such that the holes of the first and second insulating members are aligned, the hole of the first insulating member terminates in a prismatic recess, and the hole of the second insulating member terminates in a conical recess;

a contact member disposed in the holes of the insulating members, said contact member defining an enlarged head, sized to fit within the recess in the first insulating member to prevent the contact member from rotating with respect to the first insulating member, and a conically expanded end section which extends into the conical recess in the second insulating member, thereby simultaneously securing the first and second insulating members in the respective oblong recesses of the first component and substantially preventing the contact member from being pulled from the first component; and means for electrically connecting the contact member and the first sensor conductor.

2. In a position measuring instrument comprising a first component which includes a first electrically conducting sensor conductor and a second component which includes a second electrically conducting sensor conductor, wherein one of the two components is mounted to move relative to the other component, the improvement comprising:

means for defining first and second opposed noncircular recesses in opposed surfaces of the first component;

means for defining at least one opening extending through the first component between the first and second recesses;

first and second noncircular insulating members shaped to fit within the first and second recesses, respectively, such that each insulating member is substantially prevented from rotating in the first component, each insulating member defining a hole passing therethrough such that the holes of the first and second insulating members are aligned with the opening, each of the insulating members defining a respective recess adjacent to the respective hole;

a contact member disposed in the holes of the insulating members, said contact member defining first and second protruding portions which extend into the recesses of the first and second insulating members, respectively, said protruding portions cooperating with the recesses of the insulating members simultaneously to prevent the contact member from rotating with respect to the first and second insulating members, to secure the first and second insulating members together, to retain the first and second insulating members in the respective recesses of the first component, and to substantially prevent the contact member from being pulled out of the insulating members; and means for electrically connecting the contact member with the first sensor conductor;

said recesses in the first component, insulating members, contacting member and connecting means cooperating to prevent any part of the contacting member, the insulating members, or the connecting means from extending above the first sensor conductor.

3. In a position measuring instrument comprising a first component which includes a first electrically conducting sensor conductor and a second component which includes a second electrically conducting sensor conductor, wherein one of the two components is mounted to move relative to the other component, the improvement comprising:

means for defining a first recess in a first side of the first component, said first sensor conductor being disposed on the first side;

means for defining an opening extending through the first component and opening into the recess;

an insulator disposed in the recess, said insulator defining an insulator hole aligned with the opening and an insulator recess adjacent to the insulator hole;

a plate disposed on a second side of the first component, opposed to the insulator, said plate defining a plate hole aligned with the opening and a plate recess adjacent to the plate hole;

a contact member disposed in the opening and holes and extending between the insulator and the plate, said contact member defining first and second protrusions sized to fit within the insulator recess and the plate recess, respectively; and means for electrically connecting the contact member with the first sensor conductor;

at least one of the plate and the insulator shaped to interlock with the first component to prevent rotation therebetween;

the respective one of the first and second protrusions shaped to interlock with the recess of the at least one of the plate and insulator to prevent rotation therebetween;

the plate, insulator and contact member cooperating to hold the insulator in the first recess, and the first recess, insulator, contact member, and connecting means so configured that no part of the insulator, contacting member, or connecting means extends above the first sensor conductor.

* * * * *